US008991626B2

(12) United States Patent
Crain et al.

(10) Patent No.: US 8,991,626 B2
(45) Date of Patent: Mar. 31, 2015

(54) PORTABLE LIFTING SYSTEM

(71) Applicant: The Timken Company, Canton, OH (US)

(72) Inventors: Billy Ray Crain, Rutherfordton, NC (US); Wayne E. Wilson, Forest City, NC (US); Christopher D. Huskey, Forest City, NC (US)

(73) Assignee: The Timken Company, North Canton, OH (US)

( * ) Notice: Subject to any disclaimer, the term of this patent is extended or adjusted under 35 U.S.C. 154(b) by 88 days.

(21) Appl. No.: 13/833,260

(22) Filed: Mar. 15, 2013

(65) Prior Publication Data

US 2014/0263144 A1 Sep. 18, 2014

(51) Int. Cl.
*B66C 23/42* (2006.01)
*B66C 23/48* (2006.01)

(52) U.S. Cl.
CPC ..... *B66C 23/48* (2013.01); *B66C 23/42* (2013.01)
USPC ..... 212/295; 212/299; 414/561

(58) Field of Classification Search
USPC ..... 254/323, 324, 326; 212/177, 295, 299, 212/306, 202, 230; 414/569, 591, 743, 560, 414/663, 785, 561
See application file for complete search history.

(56) References Cited

U.S. PATENT DOCUMENTS 1,861,191 A 5/1932 Russell
1,978,999 A 10/1934 Jones
2,023,790 A 12/1935 Ormsby et al.
2,315,873 A 4/1943 Richards
2,419,813 A 4/1947 Berchtold
2,520,431 A 8/1950 Pierce
2,610,744 A * 9/1952 Dague ..... 212/202
2,675,209 A * 4/1954 Freed ..... 254/2 R
2,804,979 A * 9/1957 Lassiter ..... 212/301
2,989,197 A 6/1961 Werner et al.
3,045,837 A * 7/1962 Liebherr et al. ..... 212/299
3,534,874 A 10/1970 Long
3,795,284 A * 3/1974 Mracek et al. ..... 177/144
3,876,018 A * 4/1975 Mracek et al. ..... 177/132
3,917,088 A * 11/1975 Visser ..... 414/680
4,068,827 A * 1/1978 Fanning et al. ..... 254/325
4,090,625 A * 5/1978 Walters ..... 414/743
4,135,627 A * 1/1979 McInerney ..... 212/299
4,148,401 A 4/1979 Kautetzky
4,503,983 A 3/1985 Lew
4,700,851 A * 10/1987 Reeve et al. ..... 212/181
4,706,825 A * 11/1987 Johnson ..... 212/294
4,890,973 A * 1/1990 Frison et al. ..... 414/607
4,901,980 A * 2/1990 Hansen ..... 254/9 C
5,431,526 A * 7/1995 Peterson et al. ..... 414/543
5,662,451 A * 9/1997 Muzzi et al. ..... 414/540
5,797,504 A 8/1998 Mangum
5,829,948 A * 11/1998 Becklund ..... 414/607
5,918,861 A 7/1999 Parker
5,934,490 A 8/1999 Mora
6,065,621 A 5/2000 Fatemi et al.
6,234,453 B1 * 5/2001 Block ..... 254/285
6,561,367 B2 * 5/2003 Eaton ..... 212/202
6,599,078 B1 7/2003 Elder (Continued)

*Primary Examiner* — Emmanuel M Marcelo
(74) *Attorney, Agent, or Firm* — Michael Best & Friedrich LLP

(57) ABSTRACT

A portable lifting system includes a moveable base component including a scissors lift assembly, and a crane assembly coupled the movable base component, the crane assembly including a support member and a boom coupled to the support member.

19 Claims, 6 Drawing Sheets

(56) References Cited

U.S. PATENT DOCUMENTS

| | | | | |
|---|---|---|---|---|
| 6,983,856 | B1 | 1/2006 | Burks | |
| 7,210,590 | B2 | 5/2007 | Labrecque et al. | |
| 7,220,222 | B2 | 5/2007 | Springston et al. | |
| 7,845,622 | B1 * | 12/2010 | Riggs | 254/326 |
| 2004/0256607 | A1 * | 12/2004 | Spitsbergen | 254/334 |
| 2007/0187184 | A1 * | 8/2007 | Nasuti et al. | 187/269 |
| 2009/0025980 | A1 * | 1/2009 | Callander et al. | 175/45 |
| 2009/0272953 | A1 * | 11/2009 | Wolf | 254/7 C |
| 2010/0295005 | A1 * | 11/2010 | Riggs | 254/326 |

* cited by examiner

PORTABLE LIFTING SYSTEM

BACKGROUND

The present invention relates to a portable lifting system, and more particularly to an ergonomic, portable lifting system for use in industrial manufacturing environments.

Current portable lifting systems typically include a base, a vertical structure extending above the base, a boom connected to the vertical structure, and a wire or rope that passes over an end of the boom and is used to lift a component.

SUMMARY

In accordance with one construction, the invention provides a portable lifting system including a moveable base component including a scissors lift assembly, and a crane assembly coupled the movable base component, the crane assembly including a support member and a boom coupled to the support member.

In accordance with another construction, the invention provides a portable lifting system including a moveable base component that includes a scissors lift assembly, a plurality of wheels coupled to the scissors lift assembly, and a handle. The portable lifting system also includes a crane assembly coupled the movable base component, the crane assembly including a support member coupled to the base component, a plurality of positioning members disposed along and coupled to the support member, a telescoping boom releasably coupled to one of the positioning members, a winch, and a line coupled to the winch and extending over the telescoping boom.

Other aspects of the invention will become apparent by consideration of the detailed description and accompanying drawings.

DETAILED DESCRIPTION

Figure 1:
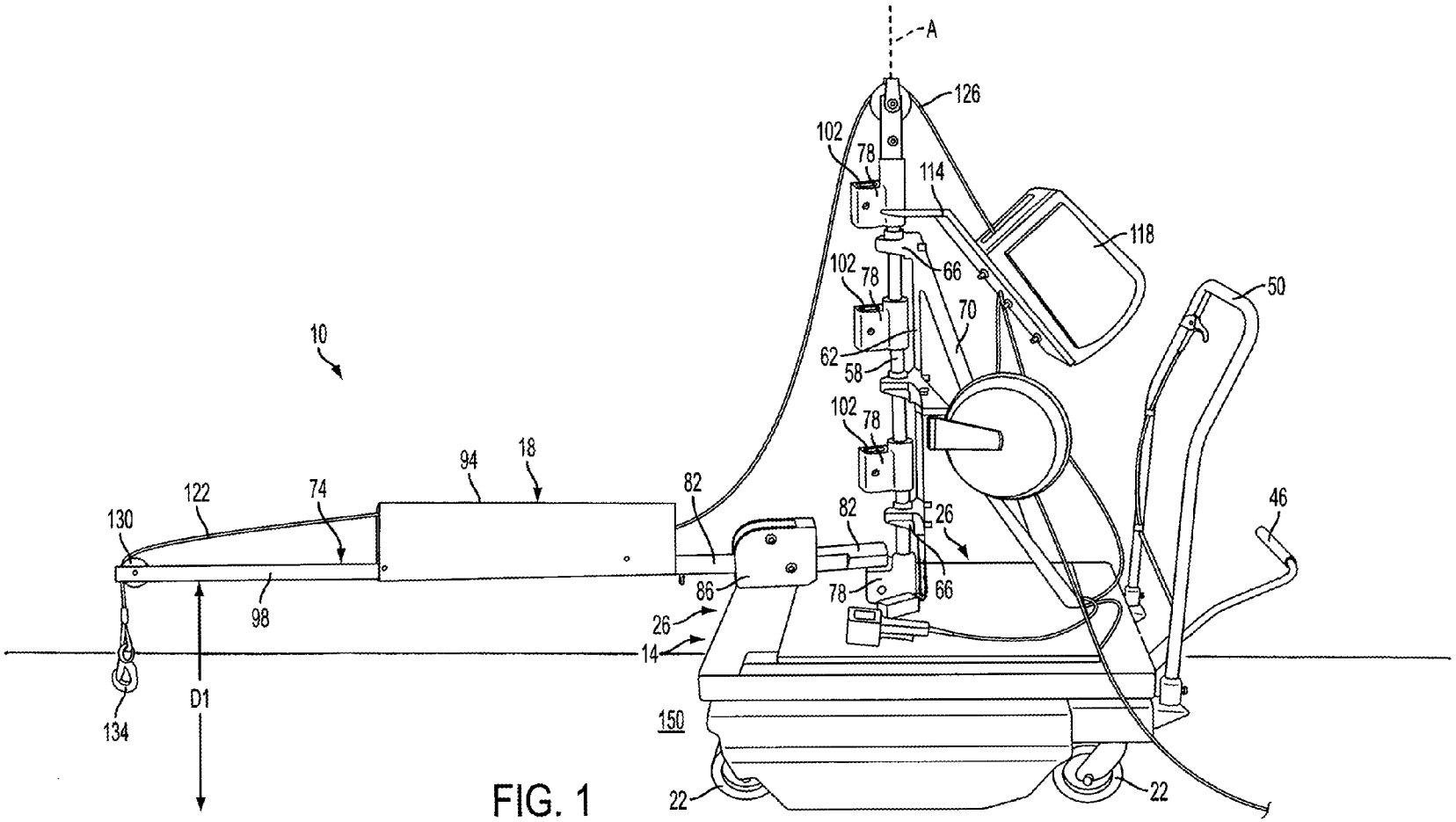
FIG. 1 is a left side perspective view of a portable lifting system according to one construction of the invention, in a fully lowered position.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

FIGS. 1-6 illustrate a portable lifting system 10. The portable lifting system 10 includes a base component 14 and a crane assembly 18 coupled to the base component 14.

The base component 14 is moveable, and includes wheels 22. The wheels 22 are caster wheels. The illustrated construction includes four wheels 22, though other constructions can include different numbers of wheels 22. In some constructions the base components 14 can include tracks or other structures that permit movement of the base component 14.

Figure 2:
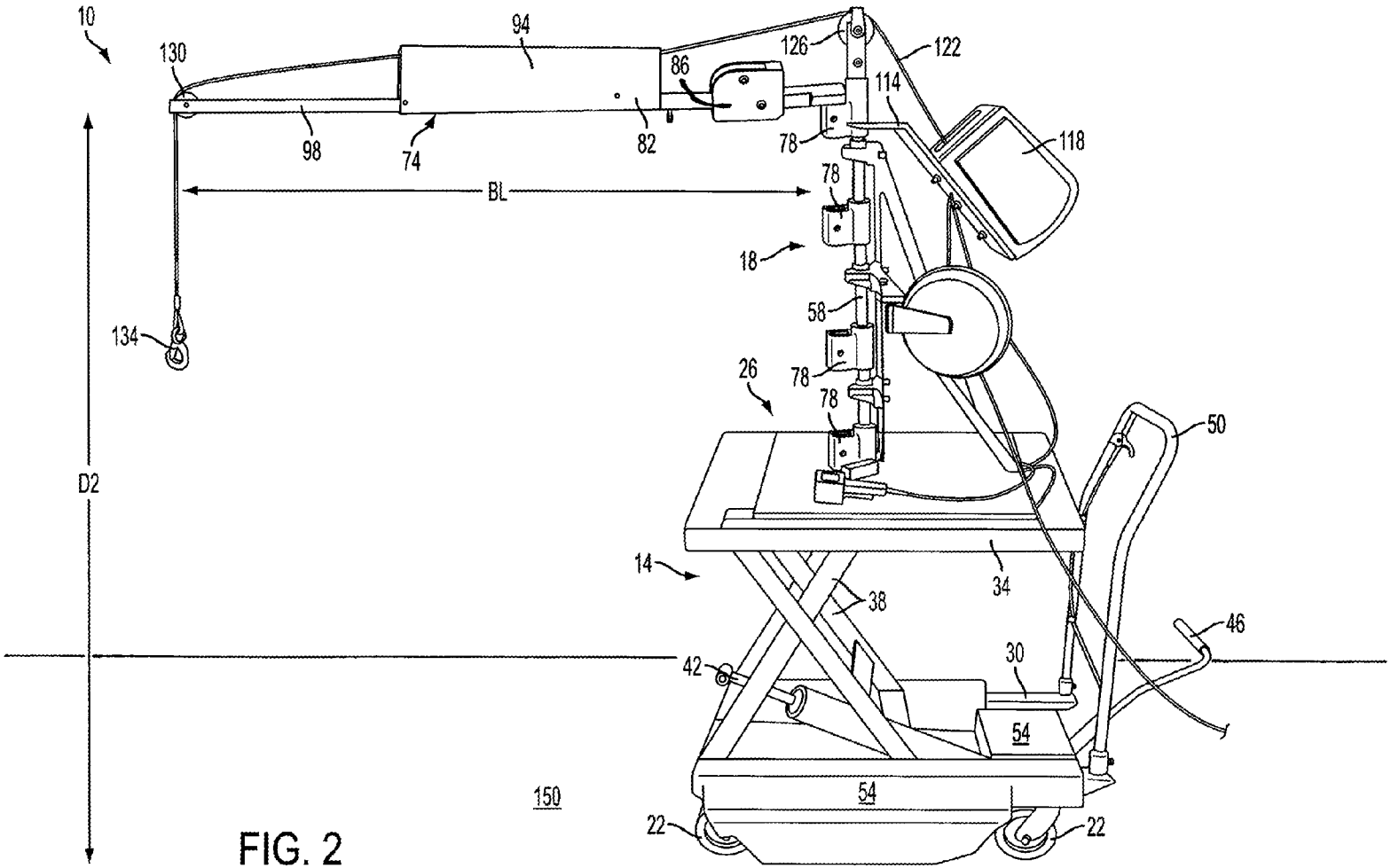
FIG. 2 is a left side perspective view of the portable lifting system of FIG. 1, in a fully raised position.

The base component 14 also includes a scissors lift assembly 26. As illustrated in FIG. 2, the scissors lift assembly 26 is coupled to the wheels 22 and includes a lower frame 30, an upper frame 34, and a plurality of moveable scissors elements 38 coupling the lower frame 30 to the upper frame 34. The scissors lift assembly 26 also includes a hydraulic cylinder 42 coupled to both the lower frame 30 and one of the scissors elements 38 to raise and lower the upper frame 34 relative to the lower frame 30. The scissors lift assembly 26 also includes a first handle 46 to operate the hydraulic cylinder 42, and a second handle 50 to push and move the overall portable lifting system 10. The base component 14 also includes counterweight structures 54 that are coupled (e.g., welded) to the lower frame 30. The counterweight structures 54 provide a counterweight to a component that is lifted by the crane assembly 18. The counterweight structures 54 prevent the portable lifting system 10 from tipping.

Figure 5:
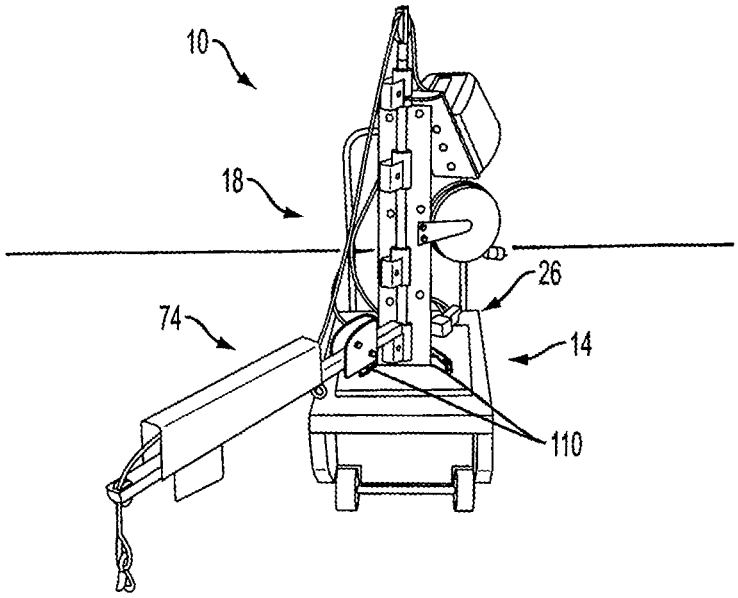
FIG. 5 is a front side perspective view of the portable lifting system of FIG. 1, in a first pivoted position.
Figure 6:
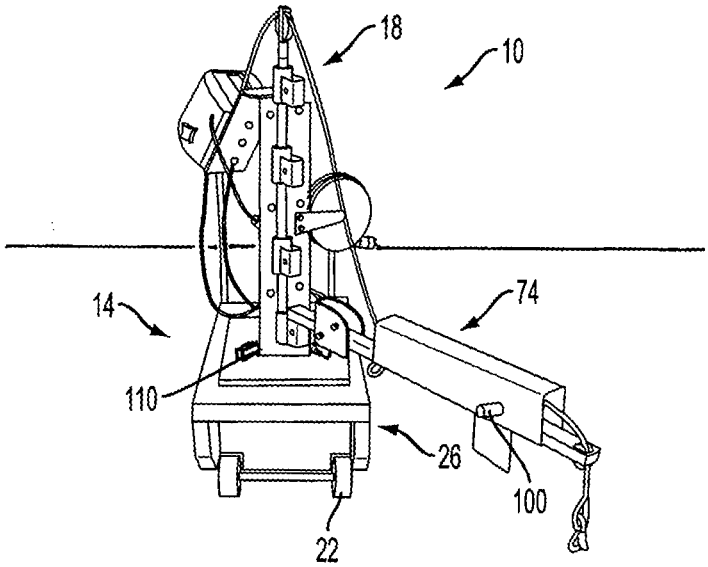
FIG. 6 is a front side perspective view of the portable lifting system of FIG. 1, in a second pivoted position.

With continued reference to FIGS. 1 and 2, the crane assembly 18 includes a support member 58 coupled to the upper frame 34 of the scissors lift assembly 26. The support member 58 extends in a generally vertical direction when the portable lifting system 10 is on a level surface. The support member 58 extends generally perpendicular to a top surface of the upper frame 34. A bottom end of the support member 58 sits in a round pocket (not shown) welded to the upper frame 34. The support member 58 defines an axis (labeled as "A" in FIG. 1), and as illustrated in FIGS. 5 and 6, is pivotable about the axis.

With reference to FIG. 1, the crane assembly 18 also includes a support member plate 62, and bearings 66. The support member plate 62 is coupled to the bearings 66, and the bearings 66 are coupled the support member 58. The support member plate 62 is coupled to or in contact with the upper frame 34, so as to provide support for the support member 58. The support member 58 is pivotable within the bearings 66. The crane assembly 18 also includes support beams 70. The support beams 70 are coupled to both the support member plate 62 and the upper frame 34. The support beams 70, the support member plate 62, and the bearings 66 provide an overall support structure for the support member 58.

Figure 4:
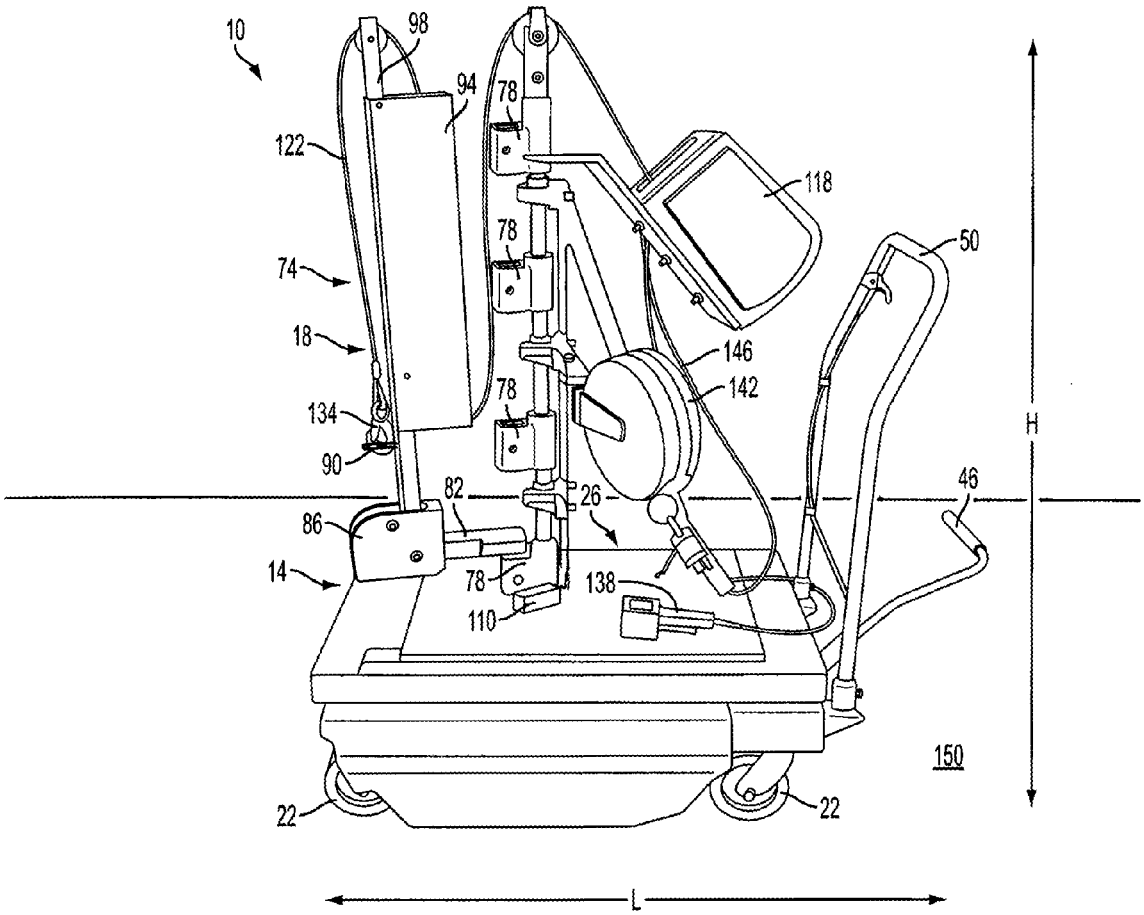
FIG. 4 is a left side perspective view of the portable lifting system of FIG. 1, in a folded position.

With reference to FIGS. 1, 2, and 4, the crane assembly 18 also includes a boom 74 and positioning members 78. The boom 74 is a separate component releasably coupled to one of the positioning members 78. The boom 74 includes a main arm 82, an arm pivot plate 86 that permits a portion of the boom 74 to be folded (as illustrated in FIG. 4), a guide 90 (illustrated in FIG. 4), guide pulleys (not shown) disposed in a guard 94, a telescoping arm 98 that is extendable and retractable from the main arm 82. With reference to FIG. 6, the boom 74 also includes a lock 100 for securing a position of the telescoping arm 98 relative to the main arm 82. The lock 100 is a spring-loaded detent pin mounted on the side of the boom 74 that engages into one of several round holes (not shown) drilled a portion of the way into the side of the telescoping arm 98.

Figure 7:
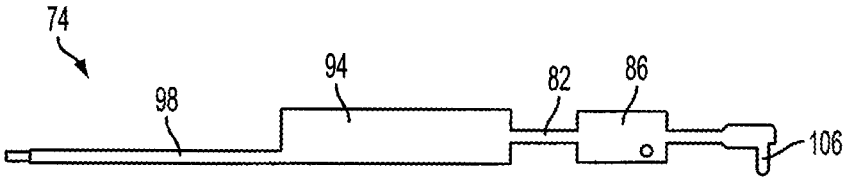
FIG. 7 is a left side view of the boom of the portable lifting system of FIG. 1.

As illustrated in FIG. 1, each of the positioning members 78 is coupled to the support member 58. The illustrated construction includes four positioning members 78, though other constructions can include different numbers of positioning members 78. The positioning members 78 are cuffs spaced generally equidistantly along the support member 58, and include openings 102. As illustrated in FIG. 7, the boom 74 includes a mating member 106 disposed at an end of the main arm 82. The mating member 106 is a pin configured to sit within one of the openings 102, so as to couple the boom 74 to the positioning member 78. As illustrated in FIGS. 1 and 2, different vertical positions of the boom 74 are achieved by removably coupling the boom 74 to the different positioning members 78.

With reference to FIGS. 4-6, the crane assembly 18 also includes arm swing dead stops 110. The arm swing dead stops 110 are coupled to the upper frame 34 and define a range of rotational freedom for the support member 58. The arm swing dead stops 110 allow the support member 58 to pivot within a range of approximately 90 degrees (i.e. 45 degrees in either direction past a normal operating position shown in FIG. 1). The arm swing dead stops 110 are blocks disposed along the upper frame 34, though other constructions can include different locations and types of arm swing dead stops 110. As the support member 58 pivots in either direction, one of the positioning members 78 eventually contacts an arm swing dead stop 110, thereby preventing further pivoting.

With reference to FIGS. 1 and 2, the crane assembly 18 also includes a winch support plate 114 coupled to one of the positioning members 78, and a winch 118 coupled to the winch support plate 114. The winch 118 is coupled to a line 122 (e.g., cable, wire, or rope). The line 122 extends from the winch 118, over a first pulley 126 coupled to the support member 58, through the guide pulleys in the guard 94, and over a distal pulley 130 at a distal end of the boom 74.

As illustrated in FIG. 2, with the telescoping arm 98 fully extended from the main arm 82 (as illustrated in FIG. 2), the boom 74 has an overall boom length "BL" (measured from the distal pulley 130 to the positioning member 78) of approximately five feet, four inches. With the telescoping arm 98 fully retracted inside the main arm 82, the boom 74 has an overall boom length of approximately forty inches. Other constructions permit different boom lengths for the boom 74.

As illustrated in FIG. 4, a coupling member 134 (a hook in the illustrated construction) is coupled to the line 122. The coupling member 134 rests on or in the guide 90 when the boom 74 is folded. The coupling member 134 is used to couple the line 122 to one or more components that are to be lifted or moved. The winch 118 is used to pay in or reel out the line 122, and to provide power to lift the one or more components with the line 122.

As illustrated in FIG. 4, the crane assembly 18 also includes a handheld winch control 138 that operates the winch 118. The winch control 138 includes operator input features that allow an operator to remotely control operation of the winch 118.

With continued reference to FIG. 4, the crane assembly 18 also includes a reel 142 and a retractable power cord 146 that is wrapped about the reel 142. The reel 142 pays out and reels in the power cord 146. The power cord 146 is plugged into an electric power source (not shown) to provide power to the winch 118.

As illustrated in FIGS. 1 and 2, the portable lifting system 10 is adjustable to a variety of different heights. For example, as illustrated in FIG. 1, the bottoms of the wheels 22 define a plane 150. In the illustrated construction, the plane 150 is a floor surface in an industrial setting. With the scissors lift assembly 26 fully retracted, and the boom 74 coupled to the lowermost positioning member 78, the boom 74 is a distance "D1" of approximately sixteen inches directly above the plane 150 (illustrated by arrow in FIG. 1). With reference to FIG. 2, with the scissors lift assembly 26 fully extended, and the boom 74 coupled to the uppermost positioning member 78, the boom 74 is a distance "D2" of approximately five feet, six inches directly above the plane 150. By changing the extension of the scissors lift assembly 26 and coupling the boom 74 to the various positioning members 78, the distance between the boom 74 and the plane 150 is adjustable to any height within a range from sixteen inches to five feet, six inches. Other constructions can include different ranges.

Figure 3:
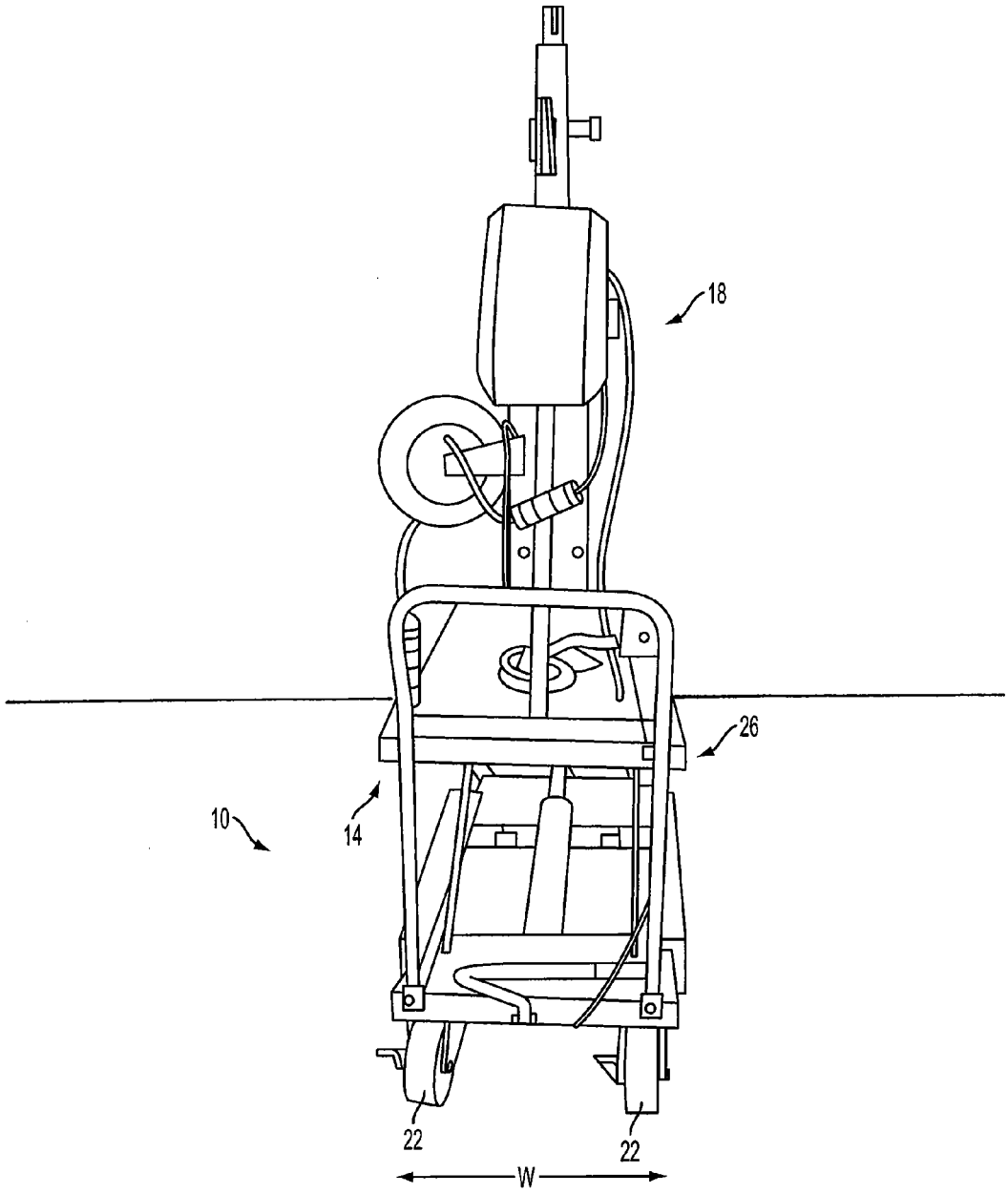
FIG. 3 is a back side view of the portable lifting system of FIG. 1.

With reference to FIGS. 3 and 4, the portable lifting system 10 is also foldable into a compact form. In particular, the portable lifting system 10 has an overall width "W" as illustrated in FIG. 3, of less than two feet (e.g., 20.25 inches in the illustrated construction). The overall height "H" of the folded portable lifting system 10, as measured from the bottom of the wheels 22 to the top of the support member 58 in FIG. 4 as illustrated in FIG. 4, is six feet or less (e.g., seventy-two inches in the illustrated construction). The overall length "L" of the portable lifting system 10, as measured from an end of the scissors lift assembly 26 adjacent the handle 46 to an opposite end of the scissors lift assembly 26 as illustrated in FIG. 4, is less than four feet (e.g., 45 inches in the illustrated construction). When the boom 74 is folded as illustrated in FIG. 4, the boom 74 is located entirely within the overall width, height, and length dimensions described above.

With reference to FIGS. 1, 5, and 6, and as described above, the portable lifting system 10 is also adjustable about the axis of rotation defined by the support member 58. In particular, the support member 58 is rotatable within a range of approximately 90 degrees (i.e. approximately 45 degrees in one direction as illustrated in FIG. 5 and approximately 45 degrees in the other direction as illustrated in FIG. 6).

The portable lifting system 10 is able to remove a component from a machine or from within another confined area. For example, to remove a component, an operator pushes the portable lifting system 10 with the handle 42, until the portable lifting system 10 is positioned adjacent the machine or area. The wheels 22 are then locked with a brake (not shown), or blocks are positioned in front of and/or behind the wheels 22. The boom 74 is coupled to a desired positioning member 78 on the support member 58, and the scissors lift assembly 26 is extended or retracted, until the boom 74 is at a desired height. The boom 74 is rotated, via the support member 58, about the axis of rotation A illustrated in FIG. 1 until the end of the boom 74 is at a desired angle. The boom 74 is extended, with the telescoping arm 98, until the boom 74 is at a desired length. The winch 118 is then operated to lower the coupling member 134 to a location adjacent a component to be lifted. The coupling member 134 is then coupled to the component, and the winch 118 is operated with the winch control 138 to raise the component. With the component raised, the portable lifting system 10 is moved to another location, and the component is manipulated into a desired position and removed from the coupling member 134.

The portable lifting system 10 is also used to lower and install a component into a machine or another confined area. For example, the portable lifting system 10 is moved to a location adjacent the machine or area, with the component already coupled to the coupling member 134. The boom 74 is rotated, via the support member 58, about the axis of rotation A illustrated in FIG. 1 until the end of the boom 74 is at a desired angle. The boom 74 is extended, with the telescoping arm 98, until the boom 74 is at a desired length. The winch 118 is then operated to lower the component into the machine, and with the component lowered, the coupling member 134 is removed from the component.

The portable lifting system 10 provides an inexpensive alternative to manual lifting of heavy components, and reduces and/or eliminates the chances of worker injury. As described above, the portable lifting system 10 quickly and efficiently lifts and moves components with ease. Because of the relatively small dimensions of the portable lifting system 10, the portable lifting system 10 advantageously reaches and lifts components in tight spaces, including spaces that are difficult to reach with human operators. The portable lifting system 10 reaches spaces that are as low as sixteen inches off the ground, and as spaces as high as up to five feet six inches above the ground. The portable lifting system 10 is able to lift both light-weight and heavy components, including components weighing up to 115 pounds. The portable lifting system 10 is durable, easy to operate, and can be used in factories, warehouses, and other industrial settings, as well as any other type of setting that might benefit from use of a small, portable lifting system 10.

Additionally, the portable lifting system 10 helps to reduce the overall task time required to install and/or remove a component. In particular, it has been found that the portable lifting system 10 reduces some task times by up to approximately 25%, thereby freeing an operator or employee to perform other tasks.

Various features and advantages of the invention are set forth in the following claims.

What is claimed is:

1. A portable lifting system comprising:

a moveable base component including a lower frame supported by wheels, an upper frame, and a scissors lift assembly disposed between the lower frame and the upper frame to move the upper frame relative to the lower frame; and a crane assembly coupled to the upper frame, the crane assembly including a support member and a boom coupled to the support member.

2. The portable lifting system of claim 1, wherein the crane assembly also includes a plurality of positioning members disposed along and coupled to the support member.

3. The portable lifting system of claim 2, wherein the boom is releasably coupled to one of the positioning members.

4. The portable lifting system of claim 3, wherein each of the positioning members is a cuff having an opening, and the boom includes a coupling member disposed in the opening.

5. The portable lifting system of claim 1, wherein the moveable base component includes a plurality of counterweights coupled to the scissors lift assembly.

6. The portable lifting system of claim 1, wherein the boom includes a telescoping arm.

7. The portable lifting system of claim 1, wherein the boom is adjustable to a folded position.

8. The portable lifting system of claim 1, wherein the support member defines an axis, and wherein the support member is pivotable about the axis.

9. The portable lifting system of claim 1, wherein the moveable base component defines a plane corresponding to a floor surface, and wherein the boom is adjustable to a distance of approximately sixteen inches above the plane.

10. The portable lifting system of claim 9, wherein the boom is further adjustable to a distance of approximately five feet, six inches above the plane.

11. The portable lifting system of claim 1, wherein the portable lifting system has an overall width of less than two feet.

12. The portable lifting system of claim 1, wherein portable lifting system has an overall height of six feet or less when in a compact configuration.

13. The portable lifting system of claim 1, wherein the portable lifting system has an overall length of less than four feet when in a compact configuration.

14. The portable lifting system of claim 1, wherein the crane assembly includes a winch coupled to the support member.

15. The portable lifting system of claim 14, wherein the crane assembly includes a plurality of pulleys, and a line contacting the plurality of pulleys, the line coupled to the winch, and extending over an end of the boom.

16. A portable lifting system comprising:

a moveable base component including a lower frame supported by wheels, an upper frame, a scissors lift assembly disposed between the lower frame and the upper frame to move the upper frame relative to the lower frame, and a handle; and a crane assembly coupled to the upper frame, the crane assembly including a support member coupled to the base component, a plurality of positioning members disposed along and coupled to the support member, a telescoping boom releasably coupled to one of the positioning members, a winch, and a line coupled to the winch and extending over the telescoping boom.

17. The portable lifting system of claim 16, wherein the crane assembly further includes a pivot plate that permits the boom to fold into a compact form.

18. The portable lifting system of claim 16, wherein the support member defines an axis, and the support member is pivotable about the axis within a range of approximately 90 degrees.

19. The portable lifting system of claim 16, wherein the moveable base component defines a plane corresponding to a floor surface, and wherein the boom is adjustable to a distance of approximately sixteen inches above the plane, and wherein the boom is further adjustable to a distance of approximately five feet, six inches above the plane.

* * * * *